United States Patent [19]

Weber

[11] Patent Number: 4,539,688

[45] Date of Patent: Sep. 3, 1985

[54] SPAR TYPE CONSUMABLE ELECTRODES FOR VACUUM ARC MELTING OF ZIRCONIUM OR TITANIUM ALLOYS

[75] Inventor: Sylvester A. Weber, Pleasant View, Utah

[73] Assignee: Westinghouse Electric Corp., Pittsburgh, Pa.

[21] Appl. No.: 541,404

[22] Filed: Oct. 13, 1983

[51] Int. Cl.[3] ..... H05B 7/07

[52] U.S. Cl. ..... 373/67; 219/146.1; 373/88

[58] Field of Search ..... 75/10 C; 373/67, 88, 373/91, 92; 219/145.1, 146.1, 146.31, 146.51

[56] References Cited

U.S. PATENT DOCUMENTS

| | | | |
|---|---|---|---|
| 1,088,296 | 2/1914 | Richards | 373/88 |
| 2,043,855 | 6/1936 | Keller | 219/146.1 |
| 2,319,977 | 5/1942 | Cape et al. | 219/145.1 |
| 2,973,428 | 2/1968 | Pfeiffer et al. | 219/146.1 |
| 3,030,706 | 4/1962 | Griffiths et al. | 219/146.1 |
| 3,400,206 | 9/1968 | Barth | 373/88 |
| 3,565,602 | 2/1971 | Konisi et al. | 75/10 C |
| 3,850,226 | 11/1974 | Cadden et al. | 373/67 |

FOREIGN PATENT DOCUMENTS

| | | | |
|---|---|---|---|
| 6047901 | 1/1979 | U.S.S.R. | 75/10 C |

*Primary Examiner*—A. D. Pellinen
*Assistant Examiner*—Gregory D. Thompson
*Attorney, Agent, or Firm*—R. A. Stoltz

[57] ABSTRACT

This is an electrode for consumable arc melting of zirconium and titanium alloys containing a low melting point alloy constituent. The electrode uses a low resistance spar extending substantially the length of the electrode and being substantially free of any unalloyed low melting point alloy constituent. The external member containing unalloyed low melting point constituent is attached to the spar member in a manner to provide a relatively high resistance through the external member in an axial direction of the electrode. During operation, this minimizes resistance heating of the external member away from the arc and thus premature melting of unalloyed low melting point constituent is generally avoided.

9 Claims, 1 Drawing Figure

SPAR TYPE CONSUMABLE ELECTRODES FOR VACUUM ARC MELTING OF ZIRCONIUM OR TITANIUM ALLOYS

BACKGROUND OF THE INVENTION

Producing homogenous alloys of high temperature reactive metals such as titanium and zirconium has presented problems. U.S. Pat. No. 3,565,602 issued to Konisi et al on Feb. 23, 1971 discusses the problem of adding constituents with different melting points and several prior art methods of dealing with these problems. The greater the temperature difference of melting points the more difficult these problems become. Tin is commonly added as an alloying constituent of zirconium alloys and is an example of a low melting point constituent, the introduction of which presents significant difficulties. While alloying constituents are often added using master alloys, master alloys of zirconium and titanium have a tendency to be pyrophoric and are prone to contribute undesirable phases such as nitrides to the alloys. Further, the master alloy is still relatively low melting and resistance heating of the electrode tends to melt the master alloy away from the arc, resulting in an inhomogeneous product. To control the amount of tin during arc melting it is common practice to contain the unalloyed tin within a tight packet of some form within the electrode.

Attempts have also been made to reduce the electrode resistance to minimize resistance heating of the electrode during melting by, for example, providing multiple welding beads longitudinally along the electrode. This technique is time consuming and not totally effective.

SUMMARY OF THE INVENTION

This is an electrode which provides for controllably and economically adding a low melting constituent (such as tin or aluminum) to a zirconium or titanium. The electrode has a high strength, low resistance spar which is substantially free of unalloyed low melting constituents and at least one external member (containing unalloyed low melting point constituents to be added) attached to the spar. The external member is to have high resistance in an axial direction to minimize its current and resistance heating and thus preventing premature melting of the unalloyed low melting point constituent.

DESCRIPTION OF THE PREFERRED EMBODIMENT

Figure 1:
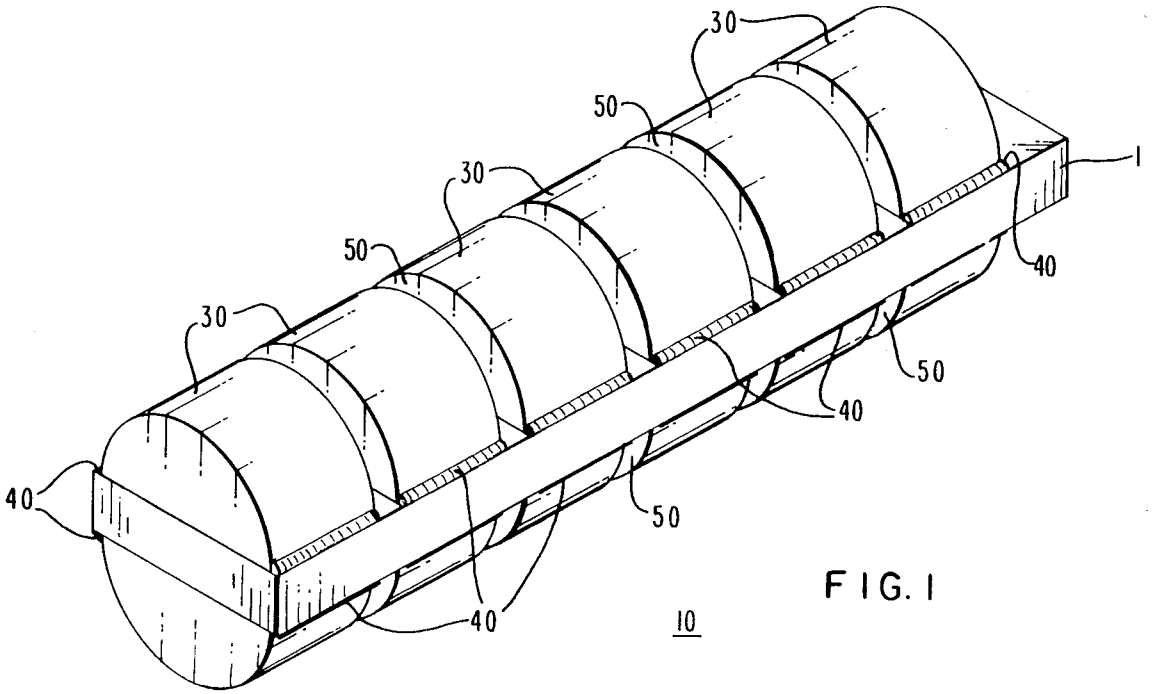
FIG. 1 is of a spar type electrode with cylindrical half segments containing unalloyed low melting point alloy constituents spaced along and welded to both sides of a low resistance spar member, the spar member being substantially free of unalloyed low melting point alloy constituents.

As used herein, the term "unalloyed low melting point alloying constituent" is used to mean an alloying constituent with a melting point of at least 1000° F. lower melting point than the zirconium or titanium which is the principal constituent of the alloy and preferably a single element (such as tin) but possibly a low melting master alloy.

The electrode of this invention utilizes a spar having low resistance in an axial direction along the length of the electrode and one or more external members attached to the spar. The external members are to have a relatively high resistance in the axial direction (along the length of the electrode) so that in the part of the electrode away from the arc the current goes mainly through the spar.

FIG. 1 shows a zirconium or zirconium alloy spar 1 having a 3-inch by 14-inch rectangular cross section and a length of approximately 200 inches. This spar forms the core of the electrode 10. Half-moon shaped segments 30 contain compacted granules of zirconium or zirconium alloy and also contain the unalloyed low melting point constituent or constituents (e.g., tin or tin and aluminum). The segments are shown welded 40 on either side of the spar 1 and are spaced along the length of the electrode 10 according to manufacturing requirements. The spar 1 may be built up from sheet or tube scrap or may be forged or rolled from an ingot (while the spar may contain some low melting constituent, it would be in alloyed form). It is critical in this technique that the spar 1 forms a low resistance core. Resistance heating of the electrode 10 in general is reduced by the lower resistance, and local heating around unalloyed tin, for example, is reduced as current through the external members (here the moon-shaped segments) is minimized, especially in the portions of the electrode away from the arc. Thus melt-out of unalloyed low melting point alloy constituents is minimized. In addition, weld time of fabrication of the electrode is minimized, since only four longitudinal welds are required to produce an electrode with sufficient strength for arc melting. The external members can, of course, be mechanically attached by methods other than welding.

The sponge or scrap containing moon-shaped segments shown in FIG. 1 are convenient, but the shape of these segments are not critical (however, the unalloyed low melting constituent is to be generally contained within the external member, rather than being on the surface where it might, for example, be melted by radiation from the arc). Further, the gaps 50 between adjacent segments 30 are convenient, but not required. It is preferable, however, that multiple segments be used, with surfaces between adjacent segments generally perpendicular to the longitudinal axis of the electrode as this provides for greatly increased resistance along the longitudinal axis through the segments and minimizes current (and thus resistance heating of the members containing the low melting point constituents). Again, current through those segments away from the arc is undesirable as it can lead to local melting (away from the arc) of the unalloyed low melting point alloying constituents or master alloys containing those alloying constituents.

In order to provide a spar 1 having sufficient structural strength and low resistance, the spar is preferably fabricated by rolling or forging and preferably has a generally rectangular slab configuration when fabricated as illustrated by FIG. 1. This rectangular slab configuration is convenient for attaching segments thereto. The half-moon segments 30 (cylindrical sections cut in two along the axis) can conveniently be prepared by pressing sponge granules or scrap into a disc-shape and then cutting the disc in two.

Both the spar and the external member are to be fabricated from relatively large pieces of metal (e.g. not from powder). The spar can be forged or rolled using granules ("granules", as used herein, means pieces with a smallest dimension of generally greater than $\frac{1}{8}$ inch, and typically dimensions in the $\frac{1}{4}$ to $\frac{3}{4}$ inch range). The external member is to contain compacted granules (the granules being principally Ti or Zr).

The segments could, of course, be of different shapes, including rectangular members whose resistance is relatively high due to being compacted only to a relatively low density (rather than having high resistance provided by gaps generally perpendicular to the longitudinal axis of the electrode).

While the invention has been described generally using tin as the low melting point alloying constituent to be added to zirconium, it can be seen that this technique is useful for other zirconium alloying constituents such as aluminum and also for low melting point alloying constituents of titanium (such as aluminum).

The examples used herein are intended to be illustrative rather than restrictive and the invention is intended to be limited only by the claims below.

I claim:

1. A consumable electrode for use in arc melting of an alloy having Zr or Ti as its principal constituent and which is to contain a low melting point alloying constituent which melts at least 1000° F. below said principal constituent, said electrode comprising:

(a) a low resistance spar core extending substantially the length of said electrode, said spar core being substantially free of unalloyed low melting point alloy constituent; and (b) an external member principally comprising an unalloyed low melting point constituent and compacted granules principally comprising Zr or Ti, said member being attached to said spar core in a manner to provide a relatively high resistance of said external member, in an axial direction of the electrode, whereby during operation, resistance heating of said external member away from an arc is minimized and thus premature melting of the unalloyed low melting point alloying constituent is generally avoided.

2. The electrode of claim 1, wherein multiple segments of external members are attached to said spar core.

3. The electrode of claim 2, wherein said multiple segments are positioned along the longitudinal axis of the electrode with surfaces between adjacent segments being generally perpendicular to the longitudinal axis of the electrode.

4. The electrode of claim 3, wherein there are gaps between adjacent segments.

5. The electrode of claim 1, wherein said spar core is a rolled or forged generally rectangular slab.

6. The electrode of claim 1, wherein said spar core principally comprises Zr and said unalloyed low melting point alloying constituent comprises tin.

7. The electrode of claim 5, wherein said spar core principally comprises Ti and said unalloyed low melting point alloying constituent comprises aluminum.

8. A consumable electrode for use in arc melting of Zr alloy which is to contain a tin alloying constituent, said electrode comprising:

(a) a low resistance spar core extending substantially the length of said electrode, said spar core being rolled or forged Zr scrap or granules or both and being substantially free of unalloyed tin and tin containing master alloy; and (b) an external member principally comprising unalloyed tin or tin containing master alloy and compacted granules principally comprising Zr, said member being attached to said spar core in a manner to provide a relatively high resistance of said external member, in an axial direction of the electrode, whereby during operation, resistance heating of said external member away from an arc is minimized and thus premature melting of the unalloyed low melting point alloying constituent is generally avoided.

9. A consumable electrode for use in arc melting of Ti alloy which is to contain an aluminum alloying constituent, said electrode comprising:

(a) a low resistance spar core extending substantially the length of said electrode, said spar core being rolled or forged Ti scrap or granules or both and being substantially free of unalloyed aluminum and aluminum containing master alloy; and (b) an external member principally comprising unalloyed aluminum or aluminum containing master alloy and compacted granules principally comprising Ti, said member being attached to said spar core in a manner to provide a relatively high resistance of said external member, in an axial direction of the electrode, whereby during operation, resistance heating of said external member away from an arc is minimized and thus premature melting of the unalloyed low melting point alloying constituent is generally avoided.

* * * * *